US007156694B1

(12) United States Patent
Anderson

(10) Patent No.: US 7,156,694 B1
(45) Date of Patent: Jan. 2, 2007

(54) ELECTRICAL OUTLET PLUG STRIP

(76) Inventor: Kenneth E. Anderson, P.O. Box 1090, Kearney, NE (US) 68848

( * ) Notice: Subject to any disclaimer, the term of this patent is extended or adjusted under 35 U.S.C. 154(b) by 180 days.

(21) Appl. No.: 10/984,236

(22) Filed: Nov. 8, 2004

(51) Int. Cl.
*H01R 13/60* (2006.01)

(52) U.S. Cl. ..... 439/535; 439/110; 439/449; 439/470; 439/359

(58) Field of Classification Search ..... 439/532–535, 439/110–116, 449, 470, 359; 362/383–384
See application file for complete search history.

(56) References Cited

U.S. PATENT DOCUMENTS

D194,870 S 3/1963 Hill ..... D26/1
D431,529 S 10/2000 Giese ..... D13/139.6
6,497,586 B1 * 12/2002 Wilson ..... 439/532

* cited by examiner

*Primary Examiner*—Truc Nguyen
(74) *Attorney, Agent, or Firm*—Thomte, Mazour & Niebergall; Dennis L. Thomte

(57) ABSTRACT

An electrical outlet plug strip comprising an elongated horizontally disposed housing having a horizontally disposed upper wall member, a vertically disposed inner wall member, a horizontally disposed bottom wall member, and an angularly disposed outer wall member which extends between the outer end of the upper wall member and the outer end of the bottom wall member. The outer wall member extends downwardly and inwardly from its upper end to its lower end and has a plurality of horizontally spaced-apart electrical outlets positioned in the angularly disposed outer wall member. The angularly disposed outer wall member may also have a low voltage receptacle provided therein which enables low voltage lights to be powered thereby.

18 Claims, 4 Drawing Sheets

ELECTRICAL OUTLET PLUG STRIP

BACKGROUND OF THE INVENTION

1. Field of the Invention

This invention relates to an electrical outlet plug strip and more particularly to an electrical outlet plug strip for use beneath a kitchen cabinet positioned above a kitchen countertop.

2. Description of the Related Art

In most kitchens, cabinets are positioned above horizontally extending countertops. Frequently, electrical outlet plug strips are secured to the supporting wall directly below the bottom of the cabinet. The electrical outlet plug strips are usually of one or two designs. In one prior art design, such as illustrated in FIG. 1, the prior art plug strip includes a vertically disposed outer wall in which horizontally spaced-apart electrical outlets are provided. Although the electrical outlets are fairly visible to the person about to insert an electrical plug into one of the outlets, the close proximity of the outlet to the bottom wall of the cabinet makes it difficult for a person to grasp the electrical plug and insert the same into the outlet due to the small distance between the outlet and the bottom wall of the cabinet.

In the prior art embodiment of FIG. 2, the electrical outlets are provided in the bottom of the plug strip which eliminates the clearance problems of the strip of FIG. 1. However, since the outlets are located in the bottom wall of the strip, it is difficult, if not impossible, for a person to visually observe the outlet to enable the person to properly position the electrical plug to facilitate the insertion of the plug into the outlet. This is made especially difficult due to the fact that the countertop positioned below the cabinet makes it difficult for a person to position his/her head to observe the connection.

SUMMARY OF THE INVENTION

An electrical outlet plug strip is described comprising an elongated, horizontally disposed hollow housing having a horizontally disposed upper wall member having inner and outer ends, a vertically disposed inner wall member having upper and lower ends extending downwardly from the inner end of the upper wall member, a horizontally disposed bottom wall member having inner and outer ends extending outwardly from the lower end of the inner wall member, and an angularly disposed outer wall member which extends between the outer end of the upper wall member and the outer end of the bottom wall member. The outer wall member extends downwardly and inwardly from its upper end to the outer end of the bottom wall member. A plurality of horizontally spaced electrical outlets are positioned in the angularly disposed outer wall member.

The outer wall member is selectively removably positioned between the upper wall member and the bottom wall member with the outer wall member being snap-fitted into position between the upper and lower wall members. Preferably, the upper wall member, inner wall member and bottom wall member are formed from a one-piece extruded aluminum material. End caps are positioned at the opposite ends of the housing to selectively close the same. The housing may also contain low voltage electrical leads to enable low voltage lights, remote from the plug strip, to be powered thereby. The plug strip of this invention is ideally suited for use beneath a kitchen cabinet positioned above a horizontally disposed countertop. The angularly disposed outer wall member enables electrical plugs to be easily inserted into the outlets due to the inclined design of the outer wall member. The inclined outer wall member not only provides clearance for a person's hand, but also enables a person to visually observe the electrical outlet as the plug is being inserted thereinto.

It is therefore a principal object of the invention to provide an improved electrical outlet plug strip.

Still another object of the invention is to provide an improved electrical outlet plug strip which is ideally suited for use beneath a kitchen cabinet disposed above a kitchen countertop.

Still another object of the invention is to provide an electrical outlet plug strip of the type described above wherein electrical outlets are provided in an inclined outer wall member thereof which not only provides clearance for the person installing a plug member into the outlet but which also enables the person to observe the electrical outlet during the insertion of the plug into the outlet.

Yet another object of the invention is to provide an electrical outlet plug strip which not only contains high voltage electrical outlets, but which also includes low voltage electrical wires therein for powering low voltage lights positioned beneath a kitchen cabinet remote from the plug strip.

Still another object of the invention is to provide an electrical outlet plug strip of the type described above which is economical of manufacture, durable in use and refined in appearance.

These and other objects will be apparent to those skilled in the art.

DETAILED DESCRIPTION OF THE INVENTION

Figure 1:
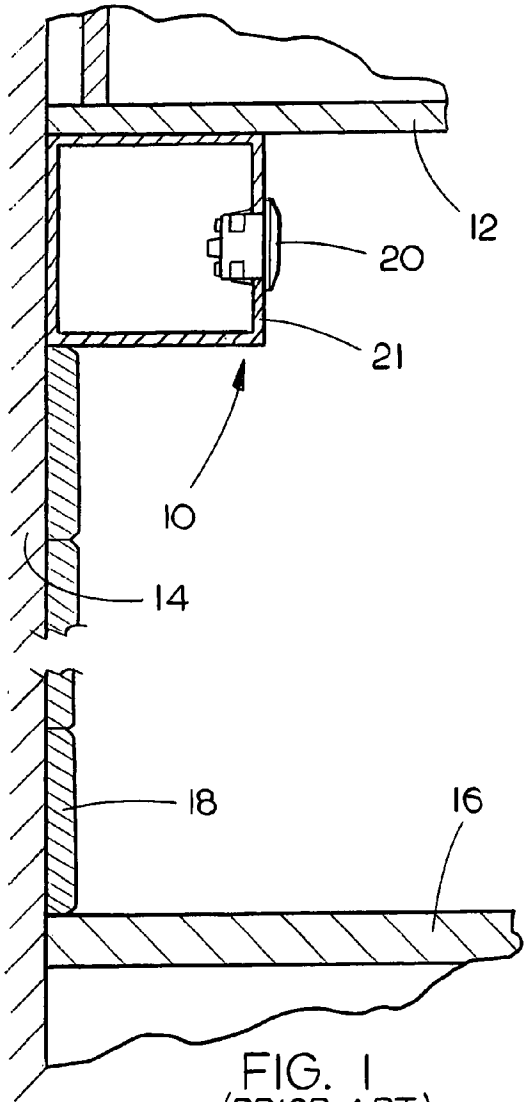
FIG. 1 (PRIOR ART)
FIG. 1 is a sectional view illustrating one type of plug strip of the prior art.
Figure 3:
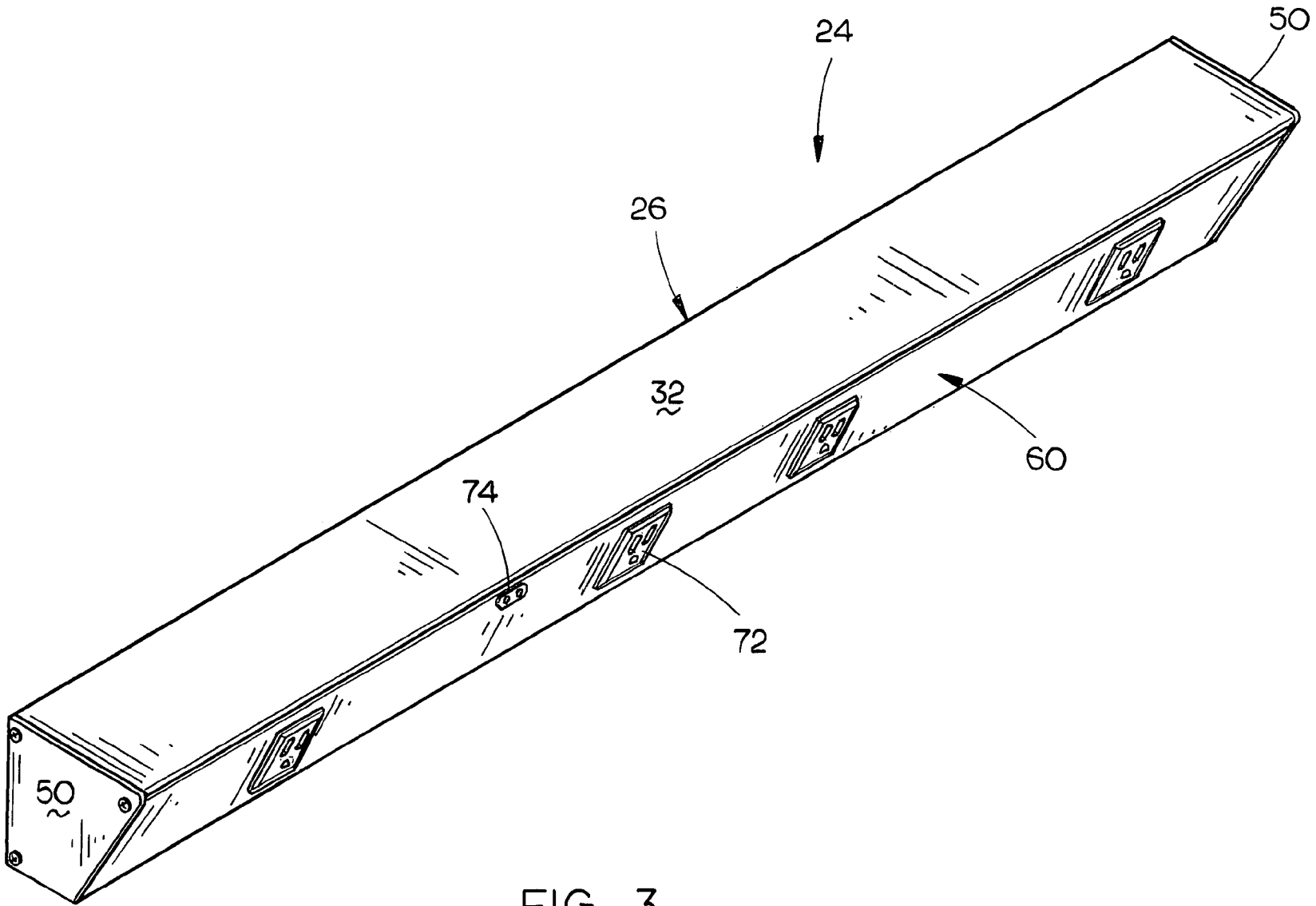
FIG. 3 is a perspective view of the plug strip of this invention.
Figure 4:
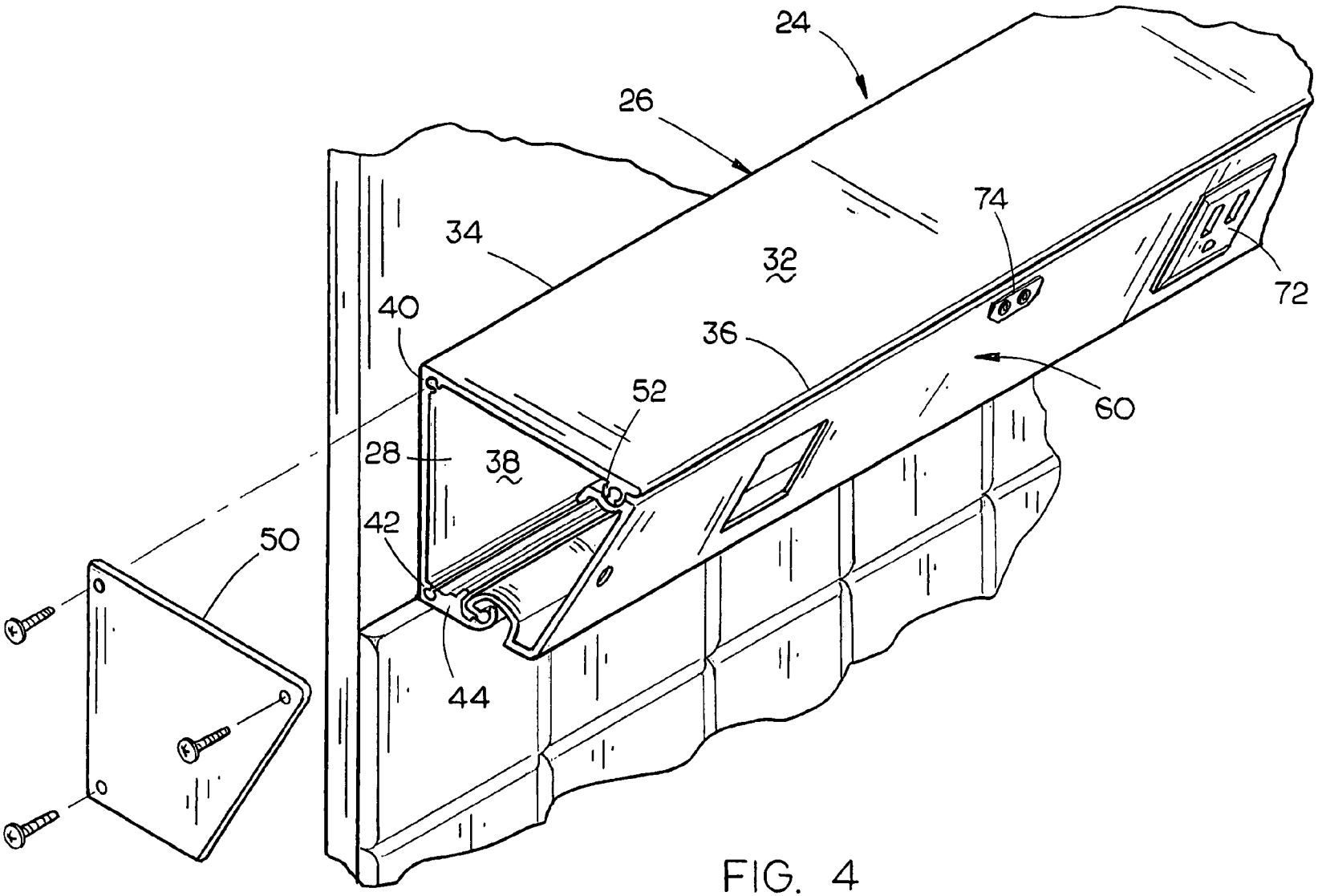
FIG. 4 is a partial exploded perspective view of the plug strip of this invention with one of the end caps illustrated in a removed position.

FIG. 1 illustrates a typical electrical outlet plug strip of the prior art and which is generally referred to by the reference numeral 10. The plug strip 10 is usually an elongated, horizontally disposed housing which is positioned directly beneath a horizontally extending bottom wall 12 of a kitchen cabinet which is secured to a vertically disposed wall 14 in conventional fashion. Usually, but not necessarily, a horizontally disposed countertop 16 extends outwardly from the wall 14 below the bottom wall 12 of the cabinet. Frequently, tile or granite 18 is secured to the exterior surface of the wall 14 between the plug strip 10 and the countertop 16. In the embodiment of FIG. 1, the electrical outlets 20 are provided in the vertically disposed outer wall 21 of the plug strip 10. The close proximity of the outlets 20 to the bottom surface of the bottom wall 12 of the cabinet makes it extremely difficult to provide sufficient clearance for a person's hand to easily insert an electrical plug into one of the outlets 20.

Figure 2:
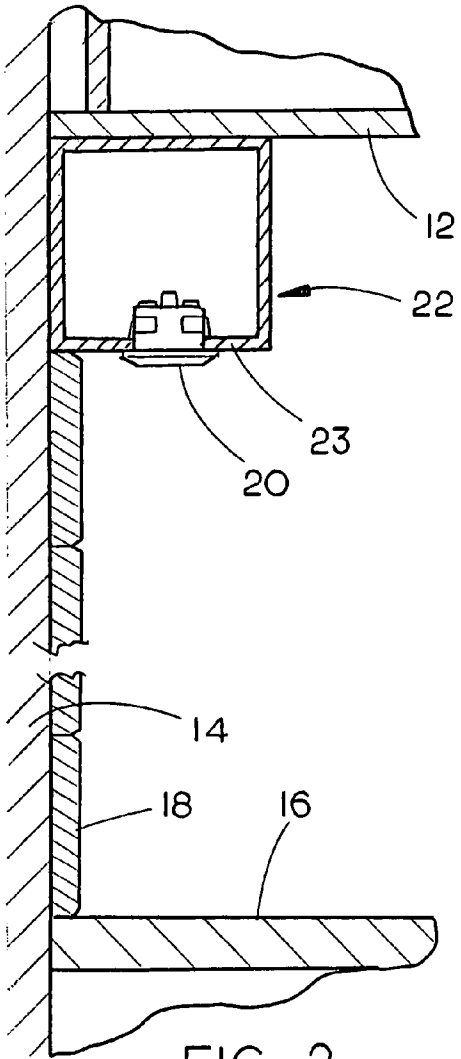
FIG. 2 (PRIOR ART)
FIG. 2 is a sectional view illustrating a second type of prior art plug strip.

FIG. 2 illustrates an electrical outlet plug strip which is referred to generally by the reference numeral 22. The plug strip 22 has the electrical outlets 20 provided in the horizontally extending bottom wall 23 thereof. Although the embodiment of FIG. 2 makes it somewhat easier to insert electrical plugs into the outlets 20, it is difficult for a person to visually observe the outlets 20 due to the positioning of the countertop 16 and the cabinet.

It is the shortcomings of the types of embodiments of FIGS. 1 and 2 that the instant invention is provided so as to not only enable a person to have sufficient clearance for his or her hand to effect the insertion of an electrical plug into an electrical outlet, but also to enable a person to be able to visually observe the electrical outlet during the plugging-in step.

Figure 5:
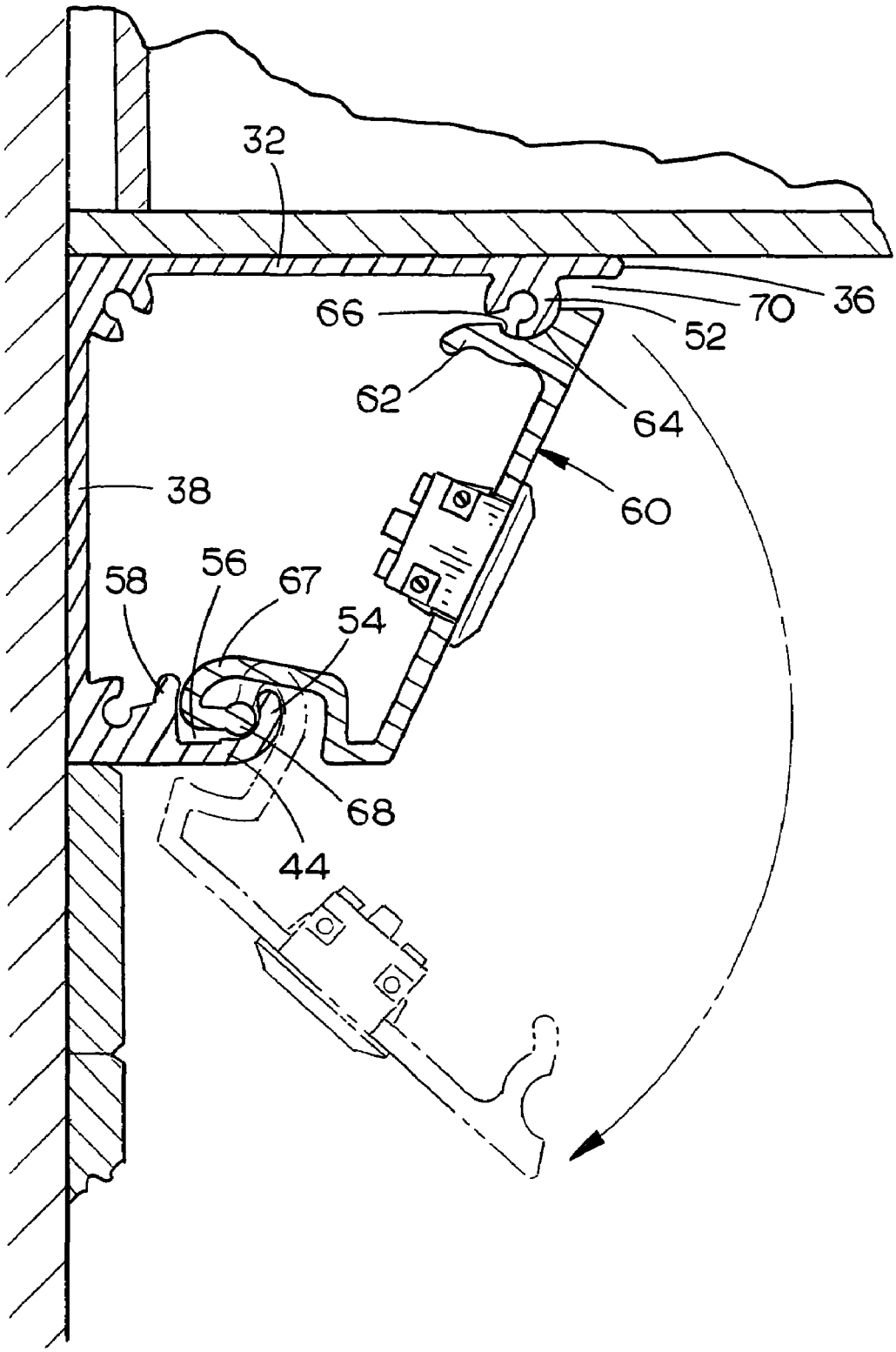
FIG. 5 is an end view of the plug strip illustrating the front wall in a closed position with the broken lines illustrating the front wall in an open position.

The electrical outlet plug strip of this invention is referred to generally by the reference numeral 24 which is comprised of an elongated, horizontally disposed housing 26 having opposite ends 28 and 30. Housing 26 includes a horizontally disposed upper wall member 32 having an inner end 34 and an outer end 36. The numeral 38 refers to an inner wall member of housing 26 which has an upper end 40 and a lower end 42. Housing 26 also includes a horizontally disposed bottom wall member 44 having an inner end 46 and an outer end 48. Preferably, upper wall member 32, inner wall member 38 and bottom wall member 44 are comprised of an extruded or pultruded aluminum material although other materials may also be utilized. The opposite ends 28 and 30 of the housing are open and are selectively closed by end caps 50. As seen in the drawings, the length of the upper wall member 32 is greater than the length of the bottom wall member 44. The upper wall member 32 is provided with an elongated arcuate connector shoulder 52 which is positioned inwardly of the outer end 36 at the bottom surface thereof, as seen in FIG. 5. Bottom wall member 44 is provided with an elongated arcuate lip 54 at its outer end which defines a recess 56. Bottom wall member 44 is also provided with a shoulder 58 which is positioned inwardly of lip 54, as seen in FIG. 5.

The numeral 60 refers to the outer wall member or cover of the housing 26 which is snap-fitted into place to close the outer end of the housing 26. The upper end of outer wall member 60 has an inwardly protruding portion 62 which defines an arcuate recess 64 and a shoulder 66. The outer wall member 60 is provided with a protruding connector element 67 including an outwardly extending member 68 at its lower end.

Outer wall member 60 is mounted on housing 26 as follows. The outer wall member 60 is manipulated so that the member 68 is positioned in the recess 56. The upper end of outer wall member 60 is pivotally moved upwardly and inwardly so that connector shoulder 52 is received by the recess 64 to effect a snap-in connection therebetween. The shoulder 66 yieldably prevents the disconnection of the upper end of the outer wall member 60 from the connector shoulder 52. When the outer wall member 60 is mounted on the housing 26 as described, the shoulder 58 prevents the lower end of the outer wall member 60 from moving inwardly with respect to the bottom wall 44. When it is desired to open the outer end of the housing 26, a screw driver or the like is inserted into the gap 70 and manipulated to disconnect the inwardly protruding portion 62 from the shoulder 52.

The outer wall 60 is provided with a plurality of horizontally spaced electrical outlets 72 formed therein which are of the 110–115 VAC type. Electrical wires extending from a source of electrical power enter the inner wall member 38 and are connected to the outlets 72 in conventional fashion. If desired, the outer surface of outer wall member 60 may be covered with a decorative plate or the like. Outer wall 60 may also have a low voltage connector or receptacle 74 provided therein which is connected to low voltage electrical leads in the interior of the housing 26. Low voltage lights positioned on the underside of the cabinet may be electrically connected to the receptacle 74 if so desired.

Thus it can be seen that the invention accomplishes at least all of its stated objectives.

I claim:

1. An electrical outlet plug strip, comprising:

an elongated, horizontally disposed housing having a horizontally disposed upper wall member having inner and outer ends, a vertically disposed inner wall member, having upper and lower ends extending down from said inner end of said upper wall member, a horizontally disposed bottom wall member having inner and outer ends extending outwardly from said lower end of said inner wall member, and an angularly disposed outer wall member extending between said outer end of said upper wall member and said outer end of said bottom wall member;

said outer wall member extending downwardly and inwardly from its said upper end to said outer end of said bottom wall member so as to be disposed at an acute angle with respect to said inner wall member and said upper wall member; and a plurality of horizontally spaced-apart electrical outlets positioned in said angularly disposed outer wall member so that said outlets are also disposed at an acute angle with respect to said inner wall member and said upper wall member.

2. The electrical outlet plug strip of claim 1 wherein said outer wall member is selectively removably positioned between said upper wall member and said bottom wall member.

3. The electrical outlet plug strip of claim 2 wherein said outer wall member is snap-fitted into position between said upper and lower wall members.

4. The electrical outlet plug strip of claim 2 wherein said lower end of said outer wall member is selectively pivotally secured to said bottom wall member and wherein said upper end of said outer wall member is snap-fitted to said outer end of said upper wall member.

5. The electrical outlet plug strip of claim 1 wherein said housing is hollow to accommodate the electrical wires for said outlets.

6. The electrical outlet plug strip of claim 1 wherein said upper wall member, said inner wall member and said bottom wall member are of one-piece construction.

7. The electrical outlet plug strip of claim 6 wherein said housing has open opposite ends and wherein end caps selectively close said open opposite ends.

8. The electrical outlet plug strip of claim 1 wherein said electrical outlets are 110–115 VAC and wherein low voltage electrical leads are also provided in said housing for connection to low voltage lights.

9. The electrical outlet plug strip of claim 8 wherein a low voltage receptacle is provided on said outer wall member, said low voltage receptacle being connected to the low voltage leads in said housing.

10. In combination:

a vertically disposed wall;

a cabinet secured to said vertically disposed wall and having a bottom wall which extends horizontally therefrom;

an electrical outlet plug strip positioned adjacent said vertically disposed wall below said bottom wall of said cabinet;

said electrical outlet plug strip comprising an elongated, horizontally disposed housing having a horizontally disposed upper wall member having inner and outer ends, a vertically disposed inner wall member, having upper and lower ends extending down from said inner end of said upper wall member, a horizontally disposed bottom wall member having inner and outer ends extending outwardly from said lower end of said inner wall member, and an angularly disposed outer wall member extending between said outer end of said upper wall member and said outer end of said bottom wall member; said outer wall member extending downwardly and inwardly from its said upper end to said outer end of said bottom wall member so as to be disposed at an acute angle with respect to said inner wall member and said upper wall member; and a plurality of horizontally spaced-apart electrical outlets positioned in said angularly disposed outer wall member so that said outlets are also disposed at an acute angle with respect to said inner wall member and said upper wall member;

said inner wall member of said housing being positioned adjacent said vertically disposed wall;

said upper wall member of said housing being positioned adjacent said bottom wall of said cabinet.

11. The combination of claim 10 wherein said outer wall member is selectively removably positioned between said upper wall member and said bottom wall member.

12. The combination of claim 11 wherein said outer wall member is snap-fitted into position between said upper and lower wall members.

13. The combination of claim 11 wherein said lower end of said outer wall member is selectively pivotally secured to said bottom wall member and wherein said upper end of said outer wall member is snap-fitted to said outer end of said upper wall member.

14. The combination of claim 10 wherein said housing is hollow to accommodate the electrical wires for said outlets.

15. The combination of claim 10 wherein said upper wall member, said inner wall member and said bottom wall member are of one-piece construction.

16. The combination of claim 15 wherein said housing has open opposite ends and wherein end caps selectively close said open opposite ends.

17. The combination of claim 10 wherein said electrical outlets are 110–115 VAC and wherein low voltage electrical leads are also provided in said housing for connection to low voltage lights.

18. The combination of claim 17 wherein a low voltage receptacle is provided on said outer wall member, said low voltage receptacle being connected to the low voltage leads in said housing.

* * * * *